US005897210A

United States Patent [19]

Giblin et al.

[11] Patent Number: 5,897,210

[45] Date of Patent: Apr. 27, 1999

[54] RECLOSABLE CONTAINER

[75] Inventors: Edward John Giblin, Finksburg, Md.; John Rzepka, Rochester, N.Y.

[73] Assignee: Lever Brothers Company, Inc., New York, N.Y.

[21] Appl. No.: 08/847,080

[22] Filed: May 1, 1997

[51] Int. Cl.[6] ..... B65D 33/16

[52] U.S. Cl. ..... 383/98; 229/123.1; 229/125.05; 220/259; 383/61; 383/66

[58] Field of Search ..... 729/123.1, 125.15, 729/125.05, 131.1; 206/254; 220/256, 259; 383/120, 104, 99, 98, 81, 78, 66, 61

[56] References Cited

U.S. PATENT DOCUMENTS

| | | | |
|---|---|---|---|
| 2,340,651 | 2/1944 | Denison . | |
| 2,601,399 | 6/1952 | Jones | 229/125.15 X |
| 2,661,137 | 12/1953 | Reid et al. | 229/125.05 |
| 2,671,596 | 3/1954 | Taylor | 229/125.05 |
| 2,705,103 | 3/1955 | Carlile | 383/98 X |
| 2,896,839 | 7/1959 | Barnes et al. . | |
| 3,325,003 | 6/1967 | Bilezerian | 229/125.15 X |
| 3,334,797 | 8/1967 | Latham et al. | 229/160.2 X |
| 3,761,013 | 9/1973 | Schuster . | |
| 3,942,713 | 3/1976 | Olson et al. . | |
| 3,949,901 | 4/1976 | Tokita . | |
| 4,066,167 | 1/1978 | Hanna et al. . | |
| 4,638,912 | 1/1987 | Graf . | |
| 4,709,399 | 11/1987 | Sanders . | |
| 4,790,670 | 12/1988 | Barbaro . | |
| 4,834,255 | 5/1989 | Boots . | |
| 4,874,096 | 10/1989 | Tessera-Chiesa . | |
| 4,901,885 | 2/1990 | Boots . | |
| 4,927,037 | 5/1990 | Boots . | |
| 5,071,025 | 12/1991 | Boots . | |
| 5,080,497 | 1/1992 | Peppiatt . | |
| 5,167,455 | 12/1992 | Forman . | |
| 5,221,143 | 6/1993 | Peppiatt . | |
| 5,282,544 | 2/1994 | Boots . | |

FOREIGN PATENT DOCUMENTS

| | | | |
|---|---|---|---|
| 0367092 | 5/1990 | European Pat. Off. | 229/123.1 |
| 1054008 | 3/1959 | Germany | 229/123.1 |

*Primary Examiner*—Gary E. Ekins
*Assistant Examiner*—Tri M. Mai
*Attorney, Agent, or Firm*—Gereard J. McGowan, Jr.

[57] ABSTRACT

A reclosable package suitable for containing large volumes of powdered detergent. The package comprises a gabled top, a slot providing access to the product, a reclosable patch covering the slot, and an overflap covering at least the portion of the patch which overlies the slot.

5 Claims, 5 Drawing Sheets

RECLOSABLE CONTAINER

BACKGROUND OF THE INVENTION

Laundry detergents generally come in two major product forms, liquids and powders. While powders have many advantages, consumers often encounter problems in neatly dispensing the product. Even the inclusion of plastic scoops, while facilitating the dispensing of detergent powders, has not completely solved the problem. In particular, there is sometimes a tendency for detergent powders to leak from the containers once they have been opened.

The arrival of price clubs and the like on the retailing scene has been accompanied by demand for larger packages containing an increased volume of product. Therefore, large containers suitable for neatly containing detergent powders are desirable.

Linpac of Austell, Georgia sells a five gallon bag comprised of flexible packaging material. Among the bags' suggested usages are detergents, pet foods and gardening products.

Prior to filling, the Linpac bag is flat and comprises four sheets of plastic, a front sheet, a rear sheet and two side sheets located between the front and rear sheets. The side sheets are each folded in half, with the folds disposed toward the middle of the flattened bag. Two opposing ends of each side sheet are bonded, one to the front sheet and the other to the rear sheet, along the sides of the flattened bag. The filled bag includes a gable structure at the top and bottom. The Linpac bag also includes a reinforcing "ring" of thin plastic sheet extending along a portion of the height of the bag throughout its internal circumference. The ring includes holes at the corners to permit powder to travel through the ring and even out the corners. The Linpac bag cites licenses under four of the Boots patents discussed below.

Boots, U.S. Pat. No. 4,834,255 discloses a container for free flowing materials such as powders, which includes a tubular outer envelope that can be closed at both ends and a tubular inner member having a circumference less than that of the outer envelope. The tubular inner member is connected to the outer envelope at least at four positions spaced circumferentially of the outer envelope.

Boots, U.S. Pat. No. 4,901,885 is directed to a container for free flowing fluid and like materials comprising a tubular outer envelope that can be closed at both ends and a tubular inner member which is connected to the outer envelope at least at four positions spaced about the circumference of the tubular outer envelope.

Boots, U.S. Pat. No. 4,927,037 is directed to a container for fluids or solids having flow properties or the like. The container comprises a box of a conventional packing material such as cardboard, a supporting frame of a material that is stronger and of greater dimensional stability, such as wood, and an inner bag of a conventional packing material such as a flexible synthetic plastic.

Boots, U.S. Pat. No. 5,071,025 relates to a package for transporting and storing bulk goods. An outer and an inner package are provided. The inner package includes an outer frame and an inner frame.

Boots, U.S. Pat. No. 5,282,544 is directed to a container for bulk materials including an enveloping member and an inner member which is connected to the enveloping member at least at four positions spaced along the circumference of the enveloping member. In filled condition, a substantially blocked-shaped unit with substantially flat walls is obtained.

SUMMARY OF THE INVENTION

The present invention is directed to a container, especially useful for housing large volumes of powdered detergent, which provides a reclosable opening. The reclosable opening particularly facilitates use of the container without undesirable leakage of powdered product.

The container of the invention includes a bottom closure, front, rear and side walls and a top end. The top end includes one or more top walls, at least one of which has an opening through which product can be removed. In accordance with one aspect of the invention, an overflap extends from at least one of the top walls and has two positions. In the first position the overflap covers the opening either directly or indirectly, and in the second position the overflap does not cover the opening. Adhesive or other means is provided for adhering the overflap to the top wall which contains the opening.

In accordance with a most preferred embodiment of the invention, the container further includes a patch which removably covers the opening. Patch adhering means adhere the patch releasably to the top wall over the opening. When both the patch and the overflap are in the closed position, the patch is preferably disposed intermediate the opening and the overflap.

Preferably the container of the invention takes the form of a bag made of flexible thermoplastic material such as polyethylene. The top end preferably comprises two top walls which slant upwardly from the front and rear walls of the container. Other preferred aspects of the top end closure extend from other side walls below the two top walls, whereby to form a "gable-like" structure. The bottom closure can be simply a bottom wall or can include a gable-like structure similar or identical to that present in the top end. The container of the invention also preferably includes a reinforcing "ring" of thin plastic sheet extending along a portion of the height of the bag throughout its internal circumference. The ring can be adhered to the front, rear and side walls with adhesive. The ring includes holes at the corners to permit powder to travel through the ring whereby to fill out the corners.

Preferably, the overflap extends from a point at which the two top walls intersect, at the top of the "gable." Although the container of the invention can be used to house liquid and solid "e.g. powdered" household products, it finds special use in powdered detergents such as powdered laundry or automatic dishwashing detergents. Advantageously, the container may, in addition to a powdered household product, also include a scoop to facilitate removal of the powder by the consumer.

The presence of the patch permits easy opening and access to the bag and scoop. The overflap likewise affords easy access to the contents of the container, but provides an additional measure of protection against leakage of the powdered product from the container once it has been opened. The presence of the reinforcing ring contributes to the integrity of the container, particularly when it takes the form of a flexible thermoplastic bag. The bag can be readily carried by two hands, each holding the bag at the gusset beneath the gables.

For a more complete understanding of the above and other features and advantages of the invention, reference should be made to the following detailed description of preferred embodiments and to the accompanying drawings.

DETAILED DESCRIPTION OF THE INVENTION

Figure 1:
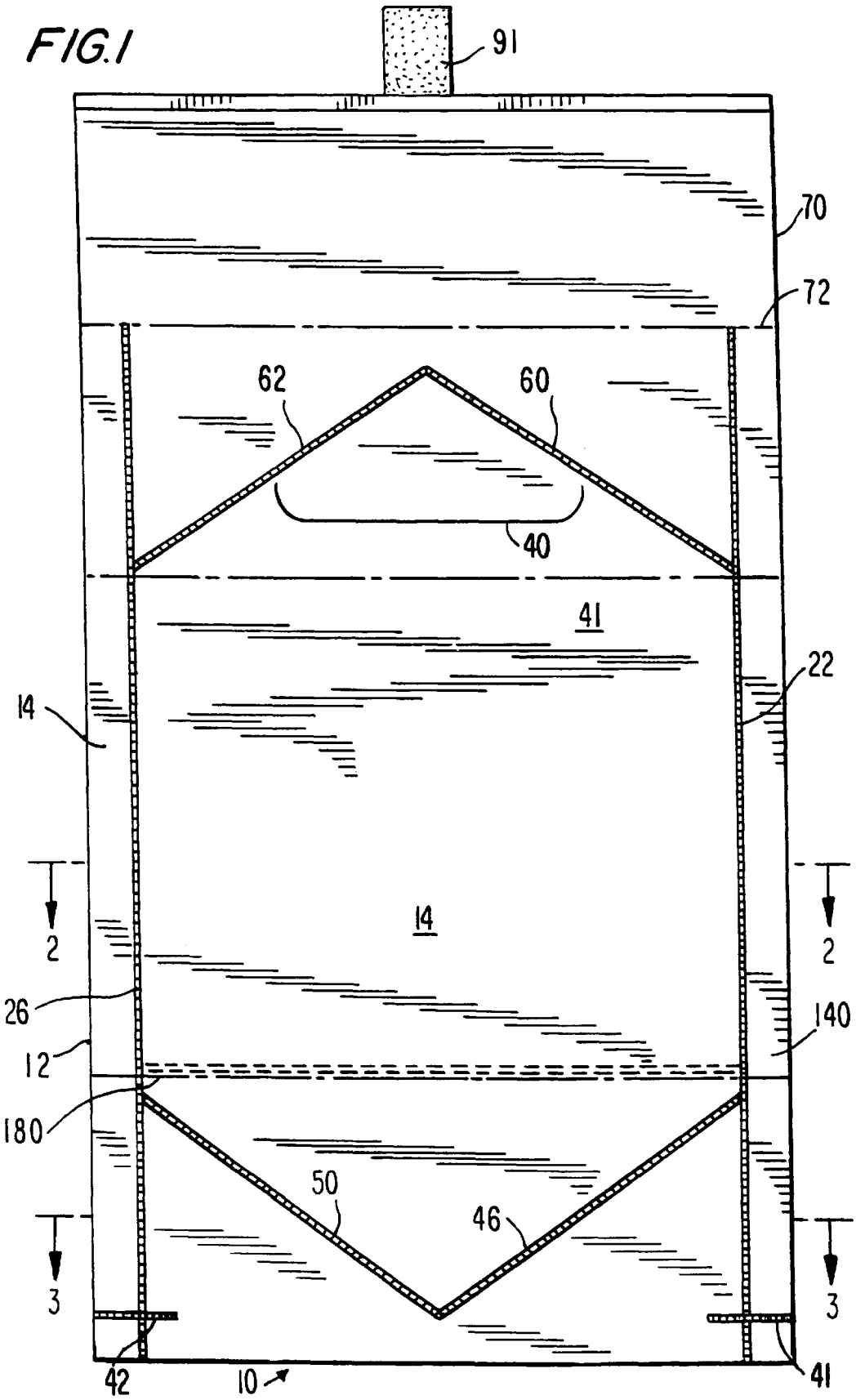
FIG. 1 is a top plan view of an empty bag which can be used to form the present container.
Figure 2:
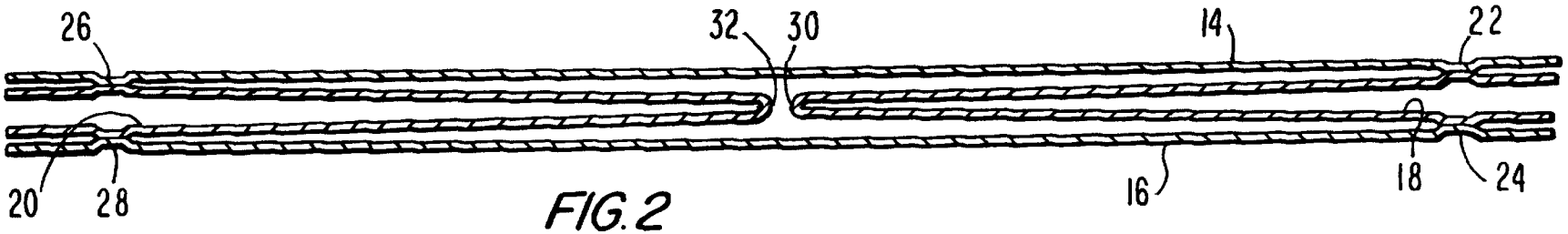
FIG. 2 is a cross section along the lines 2—2 of FIG. 1.

Bag 10 is comprised of a polymeric material 12. Bag 10 is made from four sheets of the polymeric material, a front sheet 14, a rear sheet 16 and side sheets 18 and 20. Side sheet 18 is sealed to front sheet 14 along line 22 and to rear sheet 16 along line 24. Side sheet 20 is sealed to front sheet 14 along line 26 and to rear sheet 16 along line 28. Side sheet 18 is folded in half at foldline 30 and side sheet 20 is folded in half at foldline 32.

Sheets may be sealed together by heat sealing, eg, by imposing a heated bar along the line or other configuration to be sealed.

Sheets 14, 18, 20 and 16 are sealed together along lines 40 and 42, which extend only a short distance inwardly from the side edges of the bag prior to filling of the bag, as illustrated in FIG. 1.

Front sheet 14 includes a slot 40 which will be used for dispensing product as will be discussed hereinbelow.

Figure 3:
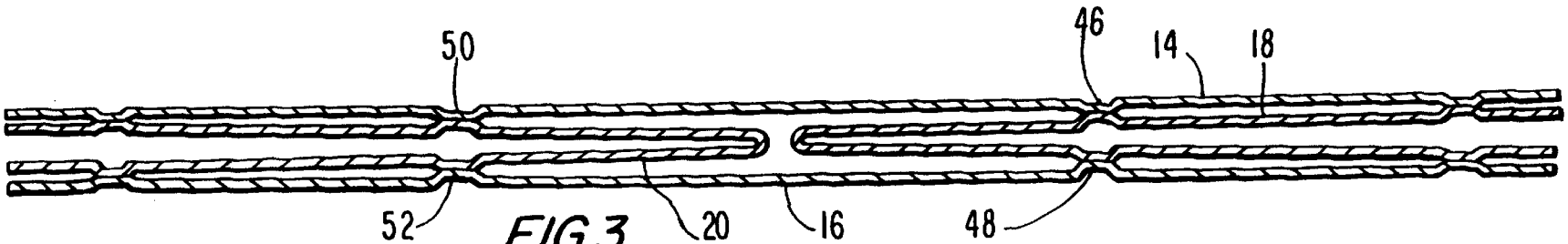
FIG. 3 is a cross section along the lines of 3—3 of FIG. 1.

As best seen in FIGS. 1 and 3, sheet 14 is heat sealed to the top half of sheet 18 at line 46 and the bottom half of sheet 18 is heat sealed to sheet 16 at line 48. Front sheet 14 is heat sealed to the top portion of sheet 20 at line 50 and the bottom half of sheet 20 is heat sealed to rear sheet 16 at line 52. Lines 46, 48, 50 and 52 extend diagonally from the heat seal margins to a point collinear with lines 40 and 42. Similar lines 60 and 62 attaching front sheet 14 to the top halves of sheets 18 and 20, as well as lines attaching the bottom halves of sheets 18 and 20 to sheet 16 are (not shown) are disposed on the other side of the bag adjacent slot 40. Ring 180 is adhered to the front, rear, and side walls and provides reinforcement to the filled bag, as will be seen in FIG. 4.

It may be desirable that sealing lines 46, 48, 50 and 52 not be imposed until after product has been placed in the bag, although they are shown in non-filled FIG. 1, for purposes of illustration.

At one end of the bag 10, seal line 72 separates the sheets from overflap 70. Overflap 70 is preferably simply a continuation of the same material separated by line 72, although it may instead be a nonintegral material sealed to the remainder of the bag.

Figure 4:
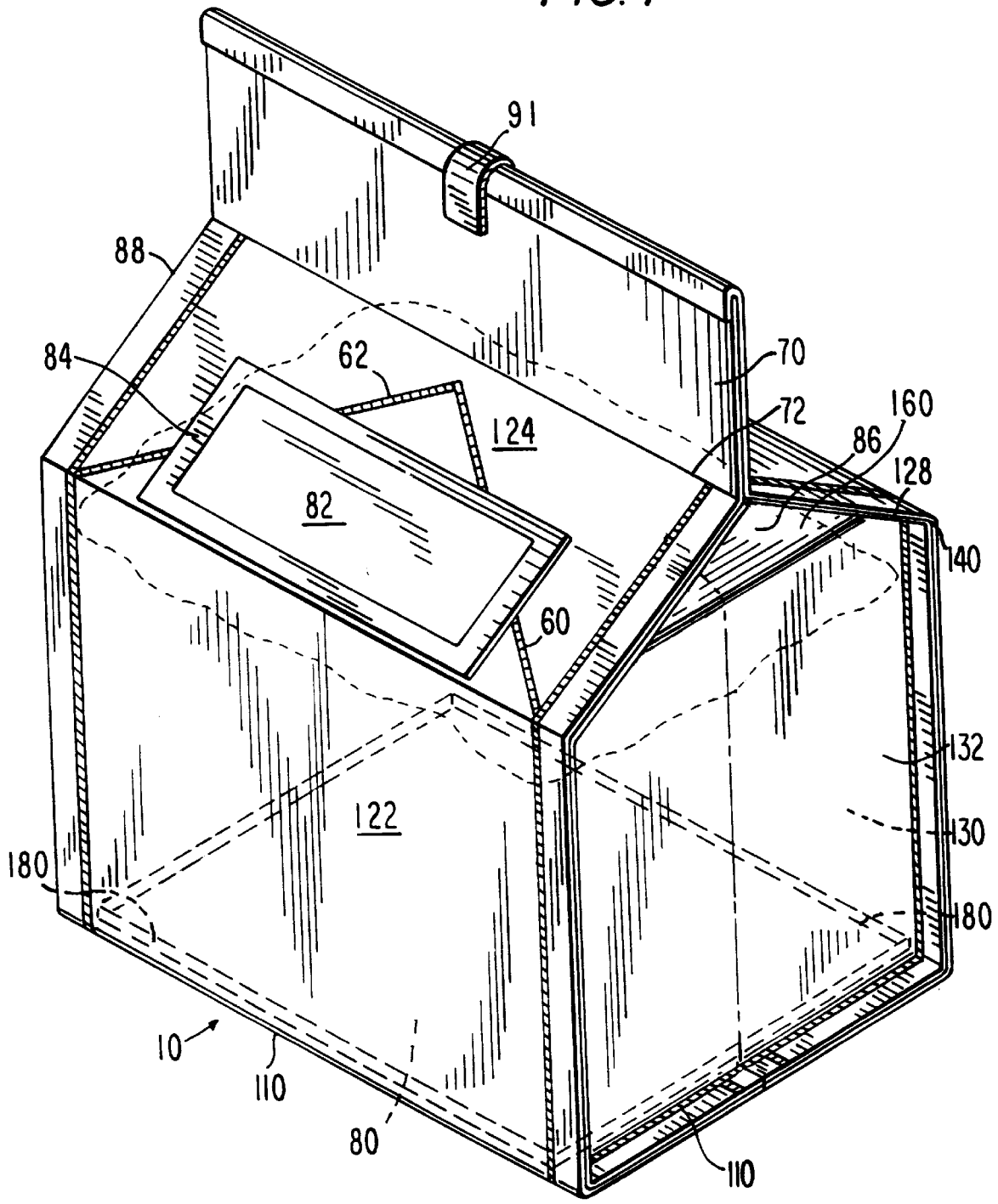
FIG. 4 is a perspective view of the container according to the invention, filled with product.

FIG. 4 illustrates the bag after filling with powdered detergent 80. The filled container 10 includes a bottom end closure 110 which is formed from a heat seal formed along lines 41, 42, the sheets and the seals along lines 46 and 50. The result is a gabled bottom end closure. Filled bag 10 also includes front wall 122, and upwardly slanting top wall 124 formed from sheet 14. Side wall 132 is formed from sheet 18. Second upwardly slanting top wall 128 extends from rear wall 130. Walls 124, 128 meet at seal line 72. Sealing margin 140 overhangs the side of the container. The material of side wall 132 continues to form a barrier 160 to prevent escape of product below the gabled top walls 124, 128. All walls may be clear, all may be opaque, or the side walls can be clear and the front and rear walls opaque. Ring 180 provides reinforcement.

As can be seen, patch 82 is taped with tape 84 and covers slot 40. The container can be grasped beneath the gables at 86 and 88. The container may also include scoop to facilitate removal of the product. The size of the scoop may be varied in accordance with factors such as the desired dimensions of the reclosable opening and the suggested dosage of the product.

Figure 5:
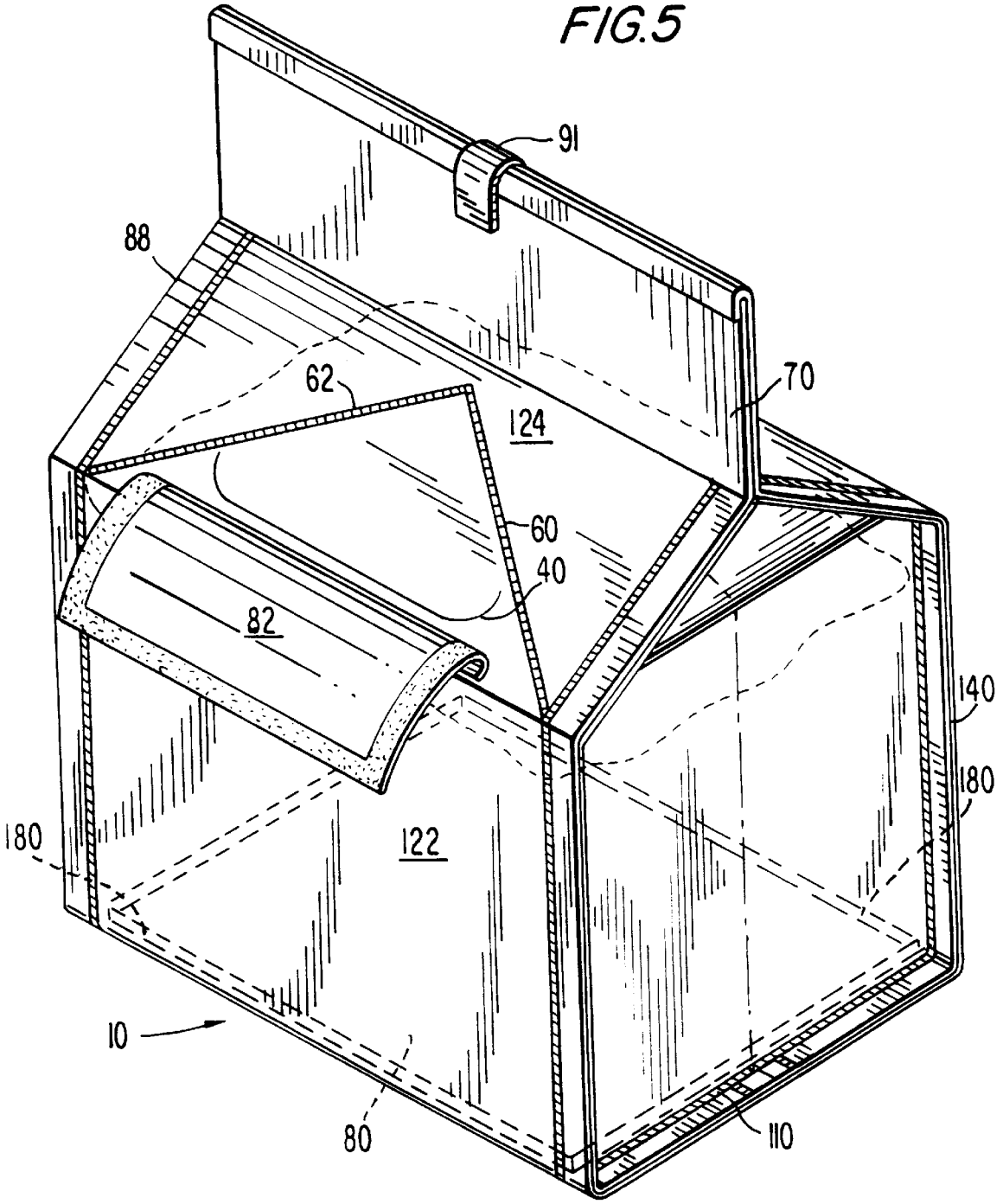
FIG. 5 is a perspective view of the container of FIG. 4 after the patch has been partially peeled off to reveal the container opening.
Figure 6:
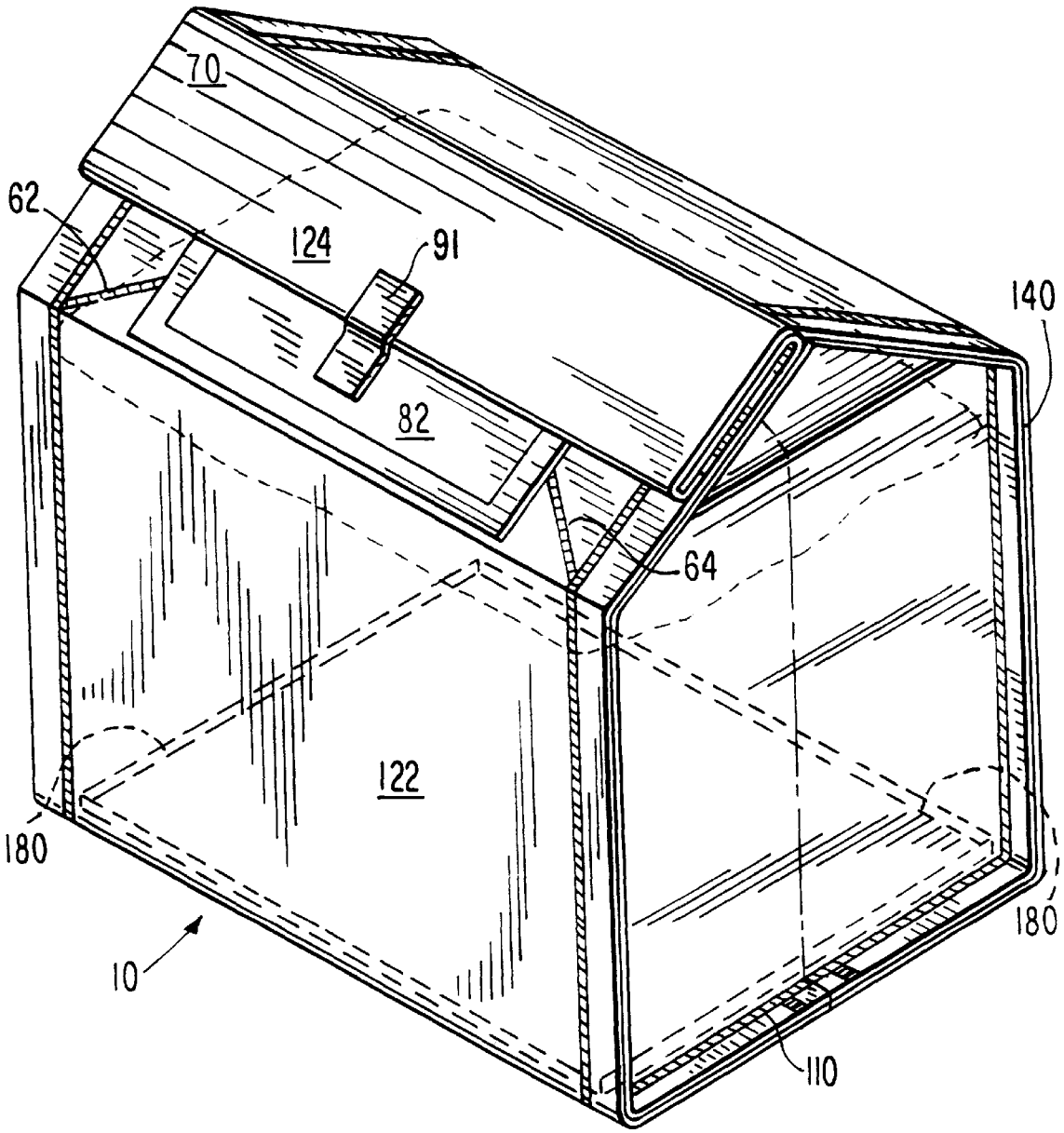
FIG. 6 is a perspective view of the container of FIG. 4 with the overflap in sealed position.

When the consumer wishes to remove product, he or she may peel patch 82 partially off of the container as seen in FIG. 5 to reveal slot 40. The consumer may then insert his or her hand through the slot to grasp scoop and remove product. When the consumer has finished removing the desired amount of detergent powder, he or she may replace the patch 82 over slot 40, again as seen in FIG. 4, Moreover, to enhance the sealing of the container the consumer may also fold overflap 70 over all or a portion of patch 82 as seen in FIG. 6. Then, adhesive tab 91 which is disposed on both sides of overflap 70 may be peeled from one side and adhered to patch 82 and/or to the tape covering it. This even further decreases the likelihood of sifting of powdered detergent product from the container, When the consumer wishes again to open the container, the overflap is peeled off of the patch or walls of the container and the overlap is returned to the open position seen in FIG. 4.

Any suitable adhering means such as adhesive tape may be used to adhere the patch to the top wall of the container and to adhere the adhering tab of the overflap to the overflap and to the patch, the patch adhesive tape and/or to the container side wall. In addition to the structure shown in FIGS. 4, et seq. wherein tab 90 includes adhesive on only one side, tab 91 can include a permanent adhesive on one side and a reclosable, pressure sensitive adhesive on the other, in which case the tab is bonded to the front of the overflap with the permanent adhesive and is the pressure sensitive adhesive bonds releasably to the top wall. In this case, the tab does not need to adhere to the rear or to the top of the overflap.

The container of the invention is preferably a bag made of clear polymeric material, however other acceptable forms, such as paperboard cartons, will be apparent to those of ordinary skill in the art. It will be understood that the container of the invention provides an advantageous package especially for large loads of powdered products. The gable structure permits the package readily to be lifted from beneath the gables and provides a position for the reclosable opening in one of the top walls, which slants upwardly from the sides of the container. While the container is illustrated as having a single reclosable opening, it will be apparent that more than one opening may be used.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A container which is a flexible thermoplastic bag comprising:

a) a bottom end closure;

b) a front wall, a rear wall and side walls;

c) a top end closure comprising i) one or more top walls, ii) at least one of said top walls having an opening, iii) an overflap extending from at least one of said top walls and having a first position covering said opening and a second position in which said opening is not covered, iv) overflap adhering means for adhering said overflap to said top wall over said opening, v) a patch removably covering said opening, vi) patch adhering means for adhering said patch to said top wall over said opening, vii) said overflap overlying said patch in said first position.

2. The container according to claim 1, wherein said one or more top walls comprise two top walls, and wherein said front and rear walls comprise a first pair of walls on opposite sides of said container, said one of said two top walls extending upwardly from one of said front and rear walls and the other of said two top walls extending upwardly from the other of said front and rear walls.

3. The container according to claim 2 wherein said upwardly extending top walls and said overflap all intersect at a location intermediate said front and rear walls.

4. The container according to claim 1 containing powdered detergent.

5. The container according to claim 1 wherein said opening is U-shaped.

* * * * *